United States Patent [19]

Fresard

[11] 4,009,673

[45] Mar. 1, 1977

[54] METHOD FOR MAKING A BUTTONHOLE ON A ZIGZAG STITCH SEWING MACHINE

[75] Inventor: Marcel Fresard, Petit-Lancy, Switzerland

[73] Assignee: Mefina S.A., Fribourg, Switzerland

[22] Filed: Dec. 30, 1975

[21] Appl. No.: 645,358

[30] Foreign Application Priority Data

July 15, 1975 Switzerland ..... 9222/75

[52] U.S. Cl. ..... 112/264; 112/437

[51] Int. Cl.[2] ..... D05B 3/06

[58] Field of Search ..... 112/264, 437, 65

[56] References Cited

UNITED STATES PATENTS

| | | | |
|---|---|---|---|
| 1,483,184 | 2/1924 | McCann | 112/437 |
| 1,722,658 | 7/1929 | Busha | 112/264 X |
| 2,977,913 | 4/1961 | Schenkengel | 112/264 |
| 3,570,433 | 3/1971 | Weisz et al. | 112/264 |

FOREIGN PATENTS OR APPLICATIONS

| | | | |
|---|---|---|---|
| 587,999 | 11/1933 | Germany | 112/264 |

*Primary Examiner*—Alfred R. Guest

*Attorney, Agent, or Firm*—Emory L. Groff, Jr.

[57] ABSTRACT

A method for making a buttonhole in a piece of material using a zigzag stitch sewing machine wherein the lips of the buttonhole are formed by the alternate stitching of opposite fractions of the desired length of the two lips, the stitching always being carried out in the same direction, and this process being repeated until the desired length is achieved. The material is moved in the reverse direction in the period between the finishing of one fraction of two opposite fractions and the starting of the other. The method is almost entirely automatic, all movements being regulated by interchangeable cams on the machine, and operator supervision is minimal.

3 Claims, 2 Drawing Figures

METHOD FOR MAKING A BUTTONHOLE ON A ZIGZAG STITCH SEWING MACHINE

The sewing of buttonholes on material, using a zigzag stitch sewing machine, is a process well known to the art and many such machines are provided with a device for the automatic sewing of buttonholes. However, such machines have hitherto still required a considerable amount of operator supervision and adjustment, for example, for the decentering of the needle and for the change in direction of the material required when one lip of a buttonhole is completed and the other is done in the reverse direction. The required change in breadth of stitch before and after the stitching of the stop stitches also need to be controlled manually.

The method which is the subject of this invention makes possible the making of buttonholes by a process which is almost completely automatic, requiring very little operator intervention. According to the present invention, there is provided a method of making a buttonhole in a piece of material using a zigzag stitch sewing machine by forming the lips of the buttonhole and then cutting the material between the lips, characterised in that the lips are formed by the alternate stitching of opposite fractions of the desired length of the two lips, this stitching always being carried out in the same direction, this stitching of opposite fractions being continued in two adjacent zones of lips until two lips of the desired length are obtained.

The invention further provides a zigzag stitch sewing machine for the performance of the method of this invention. In this machine, the lateral oscillation movements of the needle-bar, the direction of transport and the length of stitch are all controlled by one or more interchangeable cams, e.g. a single cam with a double cam profile or two cams with a single cam profile each mounted on an integral fashion.

The invention may be more fully understood by reference to the accompanying drawings which are by way of example.

Figure 1:
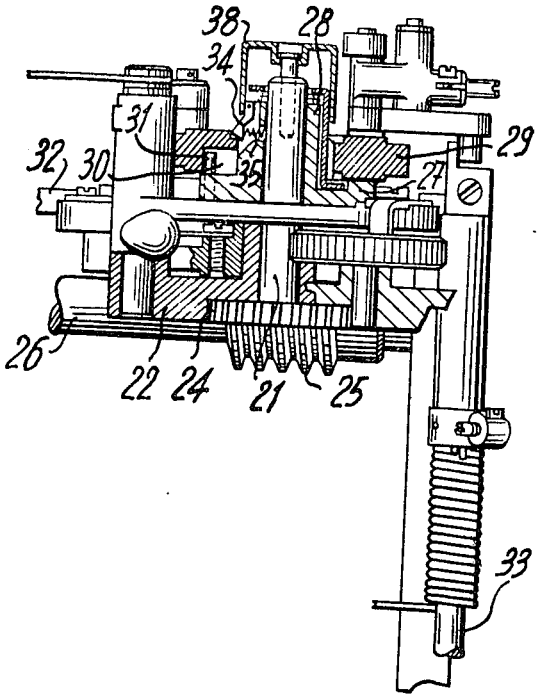
FIG. 1 is a partial section of an elevation view of that part of a zigzag stitch sewing machine which controls the making of buttonholes according to the method of the invention.

With reference to FIG. 1, a cam-bearing shaft 21 is mounted on a support 22 fixed to the framework of a sewing machine. This shaft 21 carries on its lower end a helicoidal gear 24 which is meshed with a worm gear 25 mounted on a drive shaft 26 of the machine.

A cam support 27 provided with a hub 28 is mounted on the shaft 21. A cam 29 of double cam profile is engaged on the hub 28. This cam has a slot 30 in which is engaged a stud 31 of the cam support 27, thus forcing the cam to rotate with the shaft. Three oscillating locking members 34 acted upon by springs 35 lodged in grooves of the hub 28 hold the cam 29 in driving position on the shaft. A sleeve 38 sliding freely on the hub 28 permits the retraction of the locking members into the grooves of the hub when a change of cam is desired.

One of the cam profiles of the cam 29 operates the oscillating support of the needle-bar of the machine by means of a lever 32. The other cam profile of the cam 29 operates the transporter by means of a control shaft 33.

Figure 2:
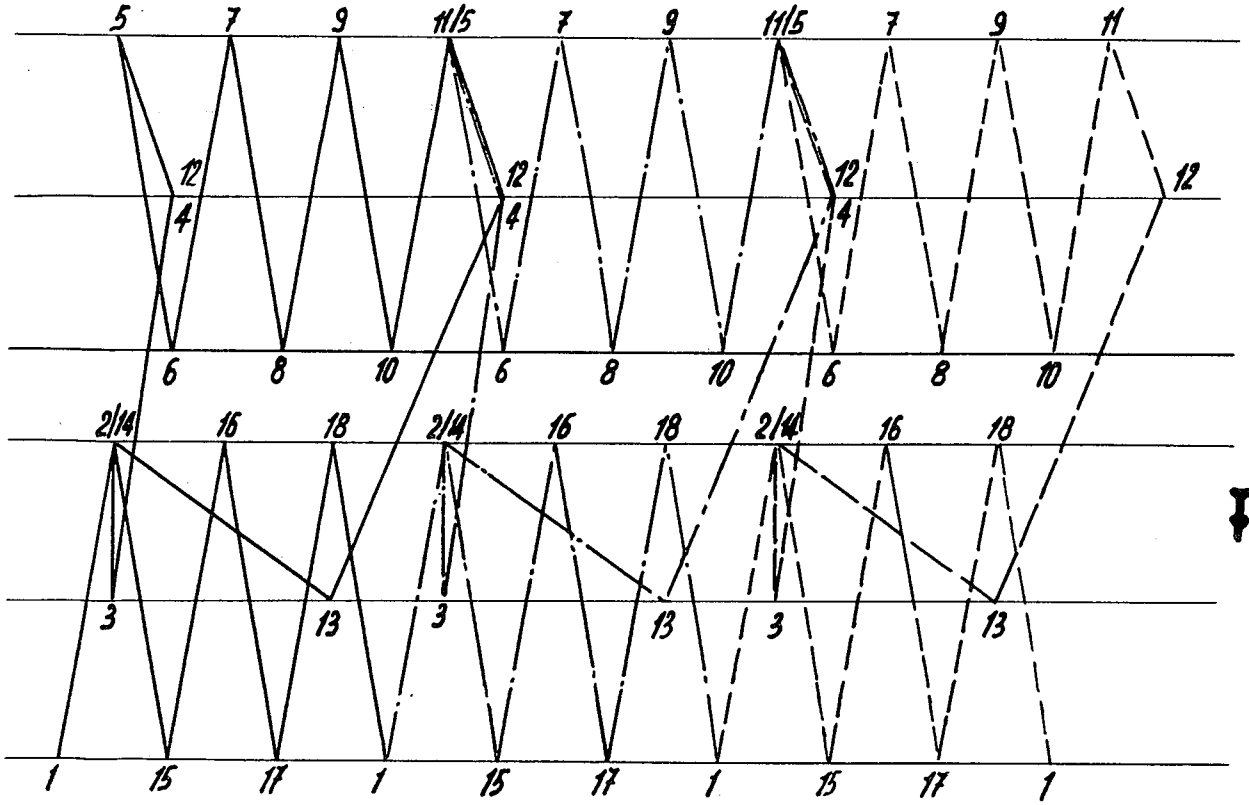
FIG. 2 is a schematic representation of the actual stitching of a buttonhole according to the method of the invention.

The actual operation of the method may be understood by reference to FIG. 2, which represents schematically the stitching carried out during three successive rotations of a cam 29.

The machine first sews the locking stitches 1,2,3,4,5 at one end of the buttonhole, and then sews the stitches 6,7,8,9,10,11 thus forming a fraction of one lip of the buttonhole. At this point, the transport of the material reverses direction and the machine executes three intermediary stitches 12,13,14 before sewing the stitches 15,16,17,18 of an opposite fraction of the other lip of the buttonhole.

By repeating this stitching operation the required number of times, a buttonhole of any length may thus be made.

It is noticeable that the buttonhole is made by alternate stitching of opposite fractions of the two lips, the stitching always being done in the same direction. The stitching operation comprises a transport of material in the direction opposite to that of the stitching, this reversal occurring between the stitching of the fraction 6-10 of the first lip and the stitching of the fraction 14-18 of the second lip.

It is also noticeable that the intermediary stitches 12–14 and 3–4 which are stitched at the time of the passage of the thread from one lip area to another while the material is transported in reverse direction are overlapped by the subsequent stitching of further opposite lip fractions of the buttonhole. They are thus prevented from outtravelling when the material between the two finished lips is cut to form the buttonhole.

In addition to the advantages already mentioned, this method permits the variation in size of buttonholes within the limits of adjustment of the width of stitch of the machine. Further, the adjusting of the two lips with respect to one another is always exact owing to the fact that the stitching of the lips is carried out in the central position of the needle and always in the same direction.

The cam profiles may of course, be changed to suit particular requirements, and as already mentioned it is permissible to use two superimposed cams mounted in an integral fashion in place of a single cam of double cam profile.

I claim:

1. In a method for making a buttonhole in a piece of material using a zigzag stitch sewing machine by forming the lips of the buttonhole and then cutting the material between the lips, the step of forming the lips by the alternate stitching of opposite fractions of the desired length of the two lips, this stitching always being carried out in the same directions, the stitching of opposite fractions being repeated in two adjacent zones of lips until two lips of the desired length are obtained.

2. Method according to claim 1, in which the material is being displaced in the opposite direction in the period between the end of the stitching of a fraction of a first lip and the start of the stitching of an opposite fraction of the second lip.

3. Method according to claim 2, in which intermediary stitches are formed on opposite areas of lips, when the thread passes from one area of lips to the other one, these intermediary stitches being overlapped by subsequent lip stitching on either side of the buttonhole.

* * * * *